US010361010B2

(12) United States Patent
Sica et al.

(10) Patent No.: US 10,361,010 B2
(45) **Date of Patent: *Jul. 23, 2019**

(54) ENERGY CABLE HAVING A CROSSLINKED ELECTRICALLY INSULATING SYSTEM, AND METHOD FOR EXTRACTING CROSSLINKING BY-PRODUCTS THEREFROM

(71) Applicant: PRYSMIAN S.P.A., Milan (IT)

(72) Inventors: Rodolfo Sica, Milan (IT); Pietro Anelli, Milan (IT)

(73) Assignee: PRYSMIAN S.P.A., Milan (IT)

( * ) Notice: Subject to any disclaimer, the term of this patent is extended or adjusted under 35 U.S.C. 154(b) by 0 days.

This patent is subject to a terminal disclaimer.

(21) Appl. No.: 15/567,829

(22) PCT Filed: Apr. 22, 2015

(86) PCT No.: PCT/IB2015/052945

§ 371 (c)(1),
(2) Date: Oct. 19, 2017

(87) PCT Pub. No.: WO2016/170391

PCT Pub. Date: Oct. 27, 2016

(65) Prior Publication Data

US 2018/0166182 A1 Jun. 14, 2018

(51) Int. Cl.
*H01B 9/02* (2006.01)
*H01B 7/00* (2006.01)
(Continued)

(52) U.S. Cl.
CPC ..... *H01B 7/0009* (2013.01); *H01B 3/006* (2013.01); *H01B 3/30* (2013.01); *H01B 13/002* (2013.01); *H01B 13/22* (2013.01)

(58) Field of Classification Search
CPC ..... H01B 9/027
(Continued)

(56) References Cited

U.S. PATENT DOCUMENTS 4,717,236 A 1/1988 Dewing
4,791,240 A 12/1988 Marin et al.
(Continued)

FOREIGN PATENT DOCUMENTS

CN 1127921 A 7/1996
CN 101679870 A 3/2010
(Continued)

OTHER PUBLICATIONS

International Search Report from the European Patent Office for International Application No. PCT/IB2015/052945, dated Jan. 8, 2016.

(Continued)

*Primary Examiner* — Chau N Nguyen
(74) *Attorney, Agent, or Firm* — Finnegan, Henderson, Farabow, Garrett & Dunner, L.L.P.

(57) ABSTRACT

An energy cable comprising at least one cable core comprising an electric conductor, a crosslinked electrically insulating system comprising an inner semiconducting layer, an insulating layer and an outer semiconducting layer and zeolite particles placed between the electric conductor and the inner semiconducting layer of the insulating system. The zeolite particles are able to efficiently extract and irreversibly absorb the by-products deriving from the cross-linking reaction, so as to avoid space charge accumulation in the insulating material during cable lifespan. This allows to eliminate the high temperature, long lasting degassing process of the energy cable cores having a crosslinked insulating layer, or at least to reduce temperature and/or duration of the same, so as to increase productivity and reduce manufacturing costs.

14 Claims, 1 Drawing Sheet

(51) Int. Cl.

| | |
|---|---|
| ***H01B 3/00*** | (2006.01) |
| ***H01B 3/30*** | (2006.01) |
| ***H01B 13/00*** | (2006.01) |
| ***H01B 13/22*** | (2006.01) |

(58) Field of Classification Search
USPC ..... 174/102 SC, 120 SC
See application file for complete search history.

(56) References Cited

U.S. PATENT DOCUMENTS

| | | | | |
|---|---|---|---|---|
| 5,190,815 | A | 3/1993 | Kobayashi et al. | |
| 5,204,402 | A | 4/1993 | Foster et al. | |
| 5,492,760 | A | 2/1996 | Sarma et al. | |
| 6,005,192 | A | 12/1999 | Mashikian et al. | |
| 6,205,276 | B1 | 3/2001 | Anelli et al. | |
| 6,383,634 | B1 | 5/2002 | Kornfeldt et al. | |
| 8,206,825 | B2 | 6/2012 | Appel et al. | |
| 8,398,803 | B2 | 3/2013 | Olsson | |
| 2003/0164483 | A1 | 9/2003 | Scelza et al. | |
| 2007/0262483 | A1 | 11/2007 | Grasselli et al. | |
| 2009/0022462 | A1 | 1/2009 | Papazoglou et al. | |
| 2009/0101387 | A1 | 4/2009 | Parsons et al. | |
| 2010/0044068 | A1 | 2/2010 | Deighton et al. | |
| 2010/0108357 | A1 | 5/2010 | Smedberg et al. | |
| 2010/0140877 | A1 | 6/2010 | Pratley | |
| 2010/0212930 | A1 | 8/2010 | Yasumoto et al. | |
| 2010/0314022 | A1 | 12/2010 | Olsson | |
| 2012/0181058 | A1 | 7/2012 | Chaudhary et al. | |
| 2012/0181061 | A1 | 7/2012 | Chaudhary et al. | |
| 2014/0220343 | A1 | 8/2014 | Choi et al. | |
| 2016/0268018 | A1* | 9/2016 | Sica | H01B 3/006 |
| 2016/0325228 | A1* | 11/2016 | Feyen | B01J 37/04 |
| 2018/0019582 | A1 | 1/2018 | Boffi et al. | |

FOREIGN PATENT DOCUMENTS

| | | | |
|---|---|---|---|
| CN | 101911213 | A | 12/2010 |
| CN | 102417683 | A | 4/2012 |
| CN | 102492199 | A | 6/2012 |
| CN | 102516694 | A | 6/2012 |
| GB | 2464610 | A | 4/2010 |
| GB | 2513991 | | 11/2014 |
| JP | 64-24308 | | 1/1989 |
| JP | 2-253513 | | 10/1990 |
| JP | 05-047238 | | 2/1993 |
| WO | WO 95/09426 | | 4/1995 |
| WO | WO 97/04466 | | 2/1997 |
| WO | WO 98/52197 | | 11/1998 |
| WO | WO 2015/059520 | | 4/2015 |
| WO | WO 2016/116779 | A1 | 7/2016 |

OTHER PUBLICATIONS

Written Opinion of the International Searching Authority from the European Patent Office for International Application No. PCT/IB2015/052945, dated Jan. 8, 2016.
McCusker, L. B. et al., "Nomenclature of Structural and Compositional Characteristics of Ordered Microporous and Mesoporous Materials With Inorganic Hosts", International Union of Pure and Applied Chemistry, vol. 73, No. 2, pp. 381-394, 2001.
American Heritage College Dictionary, 448 & 770 (3d ed. 1993).
Database WPI Week 201235 Entry dated Apr. 18, 2012 (XP-002744398) (1 page). [abstract for CN 102417683].
Fang, Z. et al., "Crosslinking and Compatibilization in Blends of Polystyrene and Polyethylene", Chinese Journal of Polymer Science, 16 (3): pp. 207-213 (1998).
International Search Report from the European Patent Office for International Application No. PCT/IB2013/059562, dated Jun. 17, 2014.
International Search Report dated Sep. 29, 2015, in PCT International Application No. PCT/IB2015/050469 (4 pages).
International Preliminary Report on Patentability dated Jul. 25, 2017, in PCT International Application No. PCT/IB2015/050469 (6 pages).
Notification of the First Office Action from the State Intellectual Property Office of the People's Republic of China, in Chinese Application No. 201380080247.2 (dated Nov. 30, 2016).
Notification of the Third Office Action in Chinese Patent Application No. 201380080247.2, dated Jan. 22, 2019 (26 pages, including translation).
Written Opinion of the International Searching Authority from the European Patent Office for International Application No. PCT/IB2013/059562, dated Jun. 17, 2014 (3 pages).
Non-final Office Action in U.S. Appl. No. 15/030,292, dated Apr. 4, 2017.
Final Office Action in U.S. Appl. No. 15/030,292, dated Oct. 20, 2017.
Advisory Action in U.S. Appl. No. 15/030,292, dated Feb. 7, 2018.
Non-final Office Action in U.S. Appl. No. 15/030,292, dated May 16, 2018.
Notification of the First Office Action in counterpart Chinese Patent Application No. 201580078984.8, dated Oct. 8, 2018 ,and Chinese Search Report in counterpart Chinese Patent Application No. 201580078984.8 (21 pages including translation).
Office Action in counterpart Russian Patent Application No. 2017135100/07(061406), dated Oct. 26, 2018 (8 pages including translation).
Search Report in counterpart Russian Patent Application No. 2017135100/07(061406), dated Oct. 25, 2018 (4 pages including translation).

* cited by examiner

ENERGY CABLE HAVING A CROSSLINKED ELECTRICALLY INSULATING SYSTEM, AND METHOD FOR EXTRACTING CROSSLINKING BY-PRODUCTS THEREFROM

CROSS-REFERENCE TO RELATED APPLICATIONS

This application is a national phase entry of PCT International Application No. PCT/IB2015/052945, filed Apr. 22, 2015, which is incorporated herein by reference.

BACKGROUND OF THE INVENTION

The present invention relates to an energy cable having a crosslinked electrically insulating system, and to a method for extracting crosslinking by-products therefrom.

Cables for transporting electric energy, particularly in the case of cables for medium or high voltage applications, include a cable core usually comprising a conductor coated with an insulating system, sequentially formed by an inner polymeric layer having semiconducting properties, an intermediate polymeric layer having electrically insulating properties, an outer polymeric layer having semiconducting properties.

Cables for transporting electric energy at medium or high voltage generally include a screen layer surrounding the cable core, typically made of metal or of metal and polymeric material. The screen layer can be made in form of wires (braids), of a tape helically wound around the cable core or a sheet longitudinally wrapped around the cable core.

The layers of such insulating system are commonly made from a polyolefin-based crosslinked polymer, in particular crosslinked polyethylene (XLPE), or elastomeric ethylene/propylene (EPR) or ethylene/propylene/diene (EPDM) copolymers, also crosslinked, as disclosed, e.g., in WO 98/52197. The crosslinking step, carried out after extruding the polymeric material onto the conductor, gives the material satisfactory mechanical and electrical properties even under high temperatures both during conventional use and with current overload.

The crosslinking process of the polyolefin materials of the cable insulation system, particularly polyethylene (XLPE), requires addition to the polymeric material of a crosslinking agent, usually an organic peroxide, and subsequent heating at a temperature to cause peroxide cleavage and reaction. By-products are formed mainly from the decomposition of the organic peroxide. In the presence of a continuous electrical field, such by-products, being entrapped within the crosslinked material, cause an accumulation of space charges which may cause electrical discharges and eventually insulation piercing, particularly in direct current (DC) energy cables. For instance, dicumyl peroxide, the most common crosslinking agent used for cable insulation, forms methane (light by-product) and heavy by-products, mainly acetophenone and cumyl alcohol. Methane can be eliminated from the cable core with a short degassing process at a relatively low temperature (about 70° C.), while acetophenone and cumyl alcohol can be removed only by subjecting the cable core to a prolonged degassing process, at a temperature suitable to cause migration of the by-products (usually about 70° C.÷80° C.) and subsequent evaporation from the cable core. This degassing process is performed for a long time (usually from 15 days to about 2 months, depending on the cable dimensions) and cannot be carried out continuously but only batchwise in large degassing devices which can host a given cable length.

Accordingly, when a crosslinked insulation system is used in energy cables, a significant degassing time and relevant costs must be taken into account.

In US 2010/0314022 a process is described for producing an insulated DC cable with an extruded polymer based electrical insulation system, which comprises the steps of: providing a polymer based insulation system comprising a compounded polymer composition, preferably a compounded polyethylene composition; optionally cross-linking the polymer composition; and finally exposing the polymer based insulation system to a heat treatment procedure while the outer surface of the polymer based insulation system is covered by a cover impermeable to at least one substance present in the polymer based insulation system in a non-homogenous distribution, thereby equalizing the concentration of the at least one substance in the polymer based insulation system. The at least one substance comprises typically cross linking by-products and various additives, which typically increase the material conductivity. Preferably a thin metallic foil or similar is wrapped around the roll of DC cable. Alternatively, the impermeable cover can be the metallic screen or the outer covering or sheath arranged outside the metallic screen. The overall effect of such a process is that of equalizing as much as possible the concentration of the crosslinking by-products within the insulating layer, which, however, are not removed from the cable core.

JP 64-024308 relates to a DC power cable provided with a space charge buffer layer placed between the inner semiconducting layer and the insulating layer or between the outer semiconducting layer and the insulating layer, the space charge buffer layer being formed by a copolymer of ethylene with an aromatic monomer, e.g. styrene, in an amount from 0.01 to 2 mol % per 1 mol of ethylene. Due to the resonance effect of the benzene ring of the aromatic monomer, the surrounding electron energy is absorbed and the formation of space charge is prevented, and in addition it is possible to improve the dielectric strength of the base polymer.

JP 02-253513 relates to a cross-linked polyethylene insulation cable that should prevent oxidative degradation caused by contact with oxygen and should enable continuous operation at high temperatures. As by-product of the organic peroxide, cumyl alcohol undergoes degradation to form α-methylstyrene and water. The degradation of cumyl alcohol is accelerated in the presence of oxygen. The moisture that is formed by the above degradation may cause appearance of voids and bow-tie trees with consequent degradation of the insulating material. To prevent such drawbacks, a plastic material containing an oxygen absorbent is arranged on the central part and the outer semiconducting layer of the conductor. As oxygen absorbent, a deoxidizer may be used, such as a commercially available product known as Ageless by Mitsubishi Gas Chemical Co., which is formed by iron oxide/potassium chloride.

The patent application PCT/IB2013/059562 discloses an energy cable comprising at least one cable core comprising an electric conductor, a crosslinked electrically insulating layer, and zeolite particles placed in the cable core. Assuming a final target of 0.32 wt % of cumyl alcohol content, the zeolite particles are present in an amount of from 70 g/m to 1000 g/m for a 25 mm insulating thickness and from 27 g/m to 450 g/m for a 15 mm insulating thickness, the units being expressed as amount of zeolite particles (in grams) versus the length of the cable (in meters). The zeolite particles are dispersed in a filling material or on the surface of a yarn or tape.

According to the same document, the zeolite particles can be placed within voids among the conductor filaments, in contact with a semiconducting layer, preferably the outer semiconducting layer, and/or into a semiconducting layer, preferably the inner semiconducting layer.

SUMMARY OF THE INVENTION

The Applicant has faced the problem of eliminating the high temperature, long lasting degassing process of the energy cable cores having a crosslinked insulating layer, or at least to reduce temperature and/or duration of the same, so as to increase productivity and reduce manufacturing costs. The above goal should be achieved without increasing the complexity of the cable production and, of course, without any detrimental effects on cable performance even after many years from installation.

In particular, the Applicant faced the problem of using a reduced amount of zeolite for achieving the sought reduction of cross-linking by-products from the cross-linked insulating system. As a matter of fact, commercially available yarns or tapes can carry a limited amount of zeolite, thus a significant length of yarn or tape per cable length should be arranged in order to provide the cable with the required amount of zeolite, especially in the case of cross-linked insulating systems having remarkable thickness. Apart from economic considerations, the provision of such significant length of yarn or tape can increase the cable size and alter the geometry thereof.

Within the present invention, it has been found a cable core with zeolite particles placed between the electric conductor and the inner semiconducting layer where the zeolite particles are able to efficiently extract and irreversibly absorb the by-products deriving from the cross-linking reaction, so as to avoid space charge accumulation in the insulating material during cable lifespan.

Although not being bound to any theory, the Applicant believes that the cable zone between the electric conductor and the inner semiconducting layer is a very critical area for the degassing of the cross-linking by-products and the placement of zeolite particles in such zone allows exploiting their adsorbing features in the more efficient way, such that it has been found that a substantially lower amount of zeolite particles than expected is sufficient to achieve the required by-products absorption effect.

Therefore, according to a first aspect, the present invention relates to an energy cable comprising at least one cable core comprising an electric conductor, a crosslinked electrically insulating system comprising an inner semiconducting layer, an insulating layer and an outer semiconducting layer and zeolite particles placed between the electric conductor and the inner semiconducting layer of the insulating system.

According to a second aspect, the present invention relates to a method for extracting crosslinking by-products from a cross-linked electrically insulating system of an energy cable core, said method comprising the following sequential steps:

manufacturing an energy cable core comprising an electric conductor, a crosslinked electrically insulating system containing cross-linking by-products, and zeolite particles placed between the electric conductor and the inner semiconducting layer;

heating the energy cable core up to a temperature causing migration of the crosslinking by-products from the crosslinked electrically insulating system to the zeolite particles, thereby the zeolite particles absorb the crosslinking by-products; and then placing a metal screen around the energy cable core.

The heating step of the method of the invention causes at least one fraction of the crosslinking by-products to be substantially irreversibly absorbed into the zeolite particles, while another fraction diffuses outside the cable core.

In particular, the zeolite particles substantially irreversibly absorb some of the crosslinking by-products during the heating step. During the heating step, a fraction of crosslinking by-products which is gaseous at ambient temperature, such as methane, or which has a low boiling point, is eliminated by causing it to diffuse out of the cable core. Preferably, the heating step is carried out at a temperature of from 70° C. to 80° C., for a time from 7 to 15 days.

The presence of zeolite particles between the electric conductor and the inner semiconducting layer allows to use amount of zeolite lower than expected while avoiding the duration of the degassing procedure for a longer time (usually from 15 to 30 days), for removing high-boiling by-products, such as cumyl alcohol and acetophenone.

Preferably, the amount of zeolite particles placed between the electric conductor and the inner semiconducting of the cable of the invention is less than 0.01 g/cm$^3$, more preferably at most of 0.008 g/cm$^3$ with respect to the volume of the cross-linked insulating system. Advantageously, the amount of zeolite particles in the cable of the invention is of at least 0.003 g/cm$^3$ with respect to the volume of the cross-linked insulating system, preferably of at least 0.004 g/cm$^3$.

For the purpose of the present description and of the claims that follow, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

For the purposes of the invention the term "medium voltage" generally means a voltage of between 1 kV and 35 kV, whereas "high voltage" means voltages higher than 35 kV.

As "electrically insulating layer" it is meant a covering layer made of a material having insulating properties, namely having a dielectric rigidity (dielectric breakdown strength) of at least 5 kV/mm, preferably of at least 10 kV/mm.

As "crosslinked insulating system" it is meant an insulating system made of crosslinked polymer.

For the purpose of the present description and of the claims that follow, as "irreversible absorption" and the like it is meant that, once absorbed by the zeolite particles, no substantial release of by-products is observed after the cable is enclosed within a hermetic sheath, such as, for example, the metallic screen.

As "core" or "cable core" it is meant the cable portion comprising an electrical conductor, an inner semiconducting layer surrounding the conductor in a radially internal position with respect to the insulating layer an insulating layer surrounding said inner semiconducting layer and an outer semiconducting layer surrounding the insulating layer.

For the purpose of the present description and of the claims that follow, the term "in the cable core" means any position inside or in direct contact with at least one of the cable core components.

The cable of the invention can have one, two or three cable cores.

The zeolite particles are placed between the electric conductor and the inner semiconducting layer, advantageously in contact with the inner semiconducting layer.

According to a preferred embodiment, the zeolite particles are between the electric conductor and the inner semiconducting layer, and into or in contact with the outer semiconducting layer, in particular on the side of the outer semiconducting layer facing away from the insulating layer. In that way, the effect of the zeolite particles is exerted on both sides of the electrically insulating system, and therefore the extraction and absorption of the crosslinking by-products is more efficient.

The zeolite particles of the invention can be dispersed in or on a material placed into the cable core.

According to an embodiment, the zeolite particles are dispersed on the surface of a yarn or tape. Yarns are generally known in energy cables to be placed between the electric conductor and the inner semiconducting layer and, optionally in contact with the outer semiconducting layer to provide, for example, water-blocking properties. The yarns are generally made from polymer filaments, e.g. polyester filaments, on which particles of a hygroscopic material, for instance polyacrylate salts, can be deposited by means of an adhesive material, typically polyvinyl alcohol (PVA) or an acrylate resin. Such yarns can be modified according to the present invention by depositing on the polymer filaments zeolite particles, optionally in admixture with hygroscopic particles. In particular, the polymer filaments can be moistened with a solution of an adhesive material, and then the zeolite particles are sprinkled thereon and remain entrapped in the solution and, after drying, in the adhesive material.

A similar technique can be used to provide tapes including zeolite particles. The tapes commonly used in energy cables can be non-conductive, in case they are placed onto the cable screen, or they can be semiconducting when placed in contact with a semiconducting layer. On the tapes, usually made from a non-woven fabric of polymer filaments, particles can be deposited by means of an adhesive material, as mentioned above. Such tapes can be used for the present invention by depositing zeolite particles on the non-woven fabric.

According to the above preferred embodiments, it is apparent that the zeolite particles can be placed in the vicinity of the crosslinked insulating system by means of cable elements that are already usual components of energy cables, such as yarns or tapes or buffering filling materials, thus avoiding supplementing the cable with an additional component which would not be necessary for a conventional cable. This remarkably reduces cable manufacturing costs and time. The above advantage does not exclude the possibility of providing the energy cable with zeolite particles by means of one or more additional components purposively placed into the cable to obtain extraction and absorption of the crosslinking by-products.

The tape bearing the zeolite particles of the invention can be applied by winding with an overlapping of, for example, about 50%. More superposed wound layers of tape can be applied. The tape can also be in form of a foil longitudinally wrapped around the cable axis with lapped edges.

As regards the zeolite particles suitable for the present invention, they can be selected from a wide range of aluminosilicates of natural or synthetic origin, having a microporous structure. They act as molecular sieves due to their ability to selectively sort molecules mainly on the basis of a size exclusion process. They are also widely used as catalysts, especially in the petrochemical industry.

According to a preferred embodiment, the zeolite particles suitable for the present invention have a charge compensating cation selected from the group consisting of ammonium ($NH_4^+$) and hydron ($H^+$). The term "hydron" includes any cation of hydrogen regardless of its isotopic composition, and particularly proton ($^1H^+$) and deuteron ($^2H^+$). Particularly preferred is proton ($^1H^+$).

Although not being bound to any theory, the Applicant believes that zeolite particles with one of the above mentioned charge compensating cations are particularly effective as irreversible absorbers for the crosslinking by-products, such as acetophenone and cumyl alcohol, since these molecules, when entered within the zeolite microporous structure, seem to undertake oligomerization reactions (specifically, dimerization or also tri- or tetra-merization reaction) converting them into much more bulky molecules. As a result, the now bulky crosslinking by-products become irreversibly trapped within the zeolite structure and cannot migrate back outside, even after prolonged exposure to relatively high temperatures, such as those reached by the energy cable during use. Even in the absence of oligomerization reactions, the by-products mainly remain into the zeolite particles because their solubility into the crosslinked polymer is lower than that into the zeolite particles.

Another effect of the oligomerization reactions of the crosslinking by-products inside the zeolite particles of the invention could be that of improving the adsorption of the crosslinking by-products into the zeolite. Although not being bound to any theory, the Applicant conjectured that the oligomerized by-products displace from the zeolite reactive sites leaving these sites free to react with further incoming by-product molecules and this increase the amount of by-products adsorbed by a given amount of zeolite particles.

Preferably, the zeolite particles have a $SiO_2/Al_2O_3$ molar ratio equal to or lower than 20, more preferably equal to or lower than 15.

Preferably, the zeolite particles have a maximum diameter of a sphere than can diffuse along at least one (preferably all the three) of the cell axes directions (hereinafter also referred to as "sphere diameter") equal to or greater than 3 Å. As well known in the zeolite field, this sphere diameter provides quantitative information about the size of the channels present in the zeolite structure, which can develop in one dimension, two dimensions or three dimensions (the so called "dimensionality" which can be 1, 2 or 3). Preferably, the zeolite particles of the invention have a dimensionality of 2, more preferably of 3.

Preferably, the zeolite particles have a sodium content, expressed as $Na_2O$, equal to or lower than 0.3% by weight.

The zeolite particles having a charge compensating cation selected from the group consisting of ammonium ($NH_4^+$) and hydron ($H^+$), a $SiO_2/Al_2O_3$ molar ratio, sphere diameter and sodium content in the preferred ranges according to the invention are capable to absorb an amount of high boiling cross-linking by-products in a given time higher than other zeolite particles lacking of at least one of the mentioned features according to the invention.

More details about zeolite nomenclature and parameters can be found, e.g., in IUPAC Recommendations 2001, *Pure Appl. Chem.*, Vol. 73, No. 2, pp. 381-394, 2001, or in the website of the International Zeolite Association (IZA) (http://www.iza-structure.org).

The positioning of the zeolite particles between the electric conductor and the inner semiconducting allows using amount of zeolite particles lower than that expected. This amount can vary and can depend on the amount of by-products to be eliminated, the thickness of the insulating layer, the degassing temperature, and the final target by-products content.

As regards the crosslinked electrically insulating layer, it preferably comprises at least one polyolefin, more preferably at least one ethylene homopolymer or copolymer of ethylene with at least one alpha-olefin $C_3$-$C_{12}$, having a density from 0.910 g/cm$^3$ to 0.970 g/cm$^3$, more preferably from 0.915 g/cm$^3$ to 0.940 g/cm$^3$.

Preferably, the ethylene homopolymer or copolymer has a melting temperature ($T_m$) higher than 100° C. and/or a melting enthalpy ($\Delta H_m$) higher than 50 J/g.

Preferably, the ethylene homopolymer or copolymer is selected from: medium density polyethylene (MDPE) having a density from 0.926 g/cm$^3$ to 0.970 g/cm$^3$; low density polyethylene (LDPE) and linear low density polyethylene (LLDPE) having a density from 0.910 g/cm$^3$ to 0.926 g/cm$^3$; high density polyethylene (HDPE) having a density from 0.940 g/cm$^3$ to 0.970 g/cm$^3$. In an embodiment of the invention the crosslinked electrically insulating layer comprises LDPE.

Preferably, the polyolefin forming the crosslinked electrically insulating layer is crosslinked by reaction with at least one organic peroxide. Preferably, the organic peroxide has formula $R_1$—O—O—$R_2$, wherein $R_1$ and $R_2$, equal or different from each other, are linear or, preferably, branched alkyls $C_1$-$C_{18}$, aryls $C_6$-$C_{12}$, alkylaryls or arylalkyls $C_7$-$C_{24}$. In a preferred embodiment, the organic peroxide is selected from: dicumyl peroxide, t-butyl cumyl peroxide, 2,5-dimethyl-2,5-di(t-butyl peroxy)hexane, di-t-butyl peroxide, or mixtures thereof.

Preferably, the organic peroxide is added to the polyolefin in an amount of from 0.05% to 8% by weight, more preferably from 0.1% to 5% by weight.

The crosslinked electrically insulating layer may further comprise an effective amount of one or more additives, selected e.g. from: antioxidants, heat stabilizers, processing aids, antiscorching agents, inorganic fillers.

As regards the semiconducting layers, these are formed by a crosslinked polymeric material, preferably the same crosslinked polyolefin used for the electrically insulating layer, and at least one conductive filler, preferably a carbon black filler. The conductive filler is generally dispersed within the crosslinked polymeric material in a quantity such as to provide the material with semiconducting properties, namely to obtain a volumetric resistivity value, at room temperature, of less than 500 Ω·m, preferably less than 20 Ω·m. Typically, the amount of carbon black can range between 1 and 50% by weight, preferably between 3 and 30% by weight, relative to the weight of the polymer.

The production of the energy cable according to the present invention can be carried out according to known techniques, particularly by extrusion of the electrically insulating layer and of the at least one semiconducting layer over the electric conductor.

According to a preferred embodiment, the electric conductor is formed by a plurality of stranded electrically conducting filaments.

The zeolite particles may be also deposited on at least one yarn placed within with the stranded electrically conducting filaments.

According to an embodiment, a tape containing the zeolite particles is also wound onto an outer semiconducting layer disposed over the electrically insulating layer. Subsequently, the cable core, devoid of the metal screen, is heated to a temperature so as to cause migration of the crosslinking by-products from the crosslinked electrically insulating layer to the zeolite particles, thereby the zeolite particles absorb the crosslinking by-products. Afterwards, a metal screen is placed around the energy cable core according to well known techniques.

BRIEF DESCRIPTION OF THE DRAWING

Further characteristics will be apparent from the detailed description given hereinafter with reference to the accompanying drawings, in which.

DETAILED DESCRIPTION OF THE PREFERRED EMBODIMENTS

Figure 1:
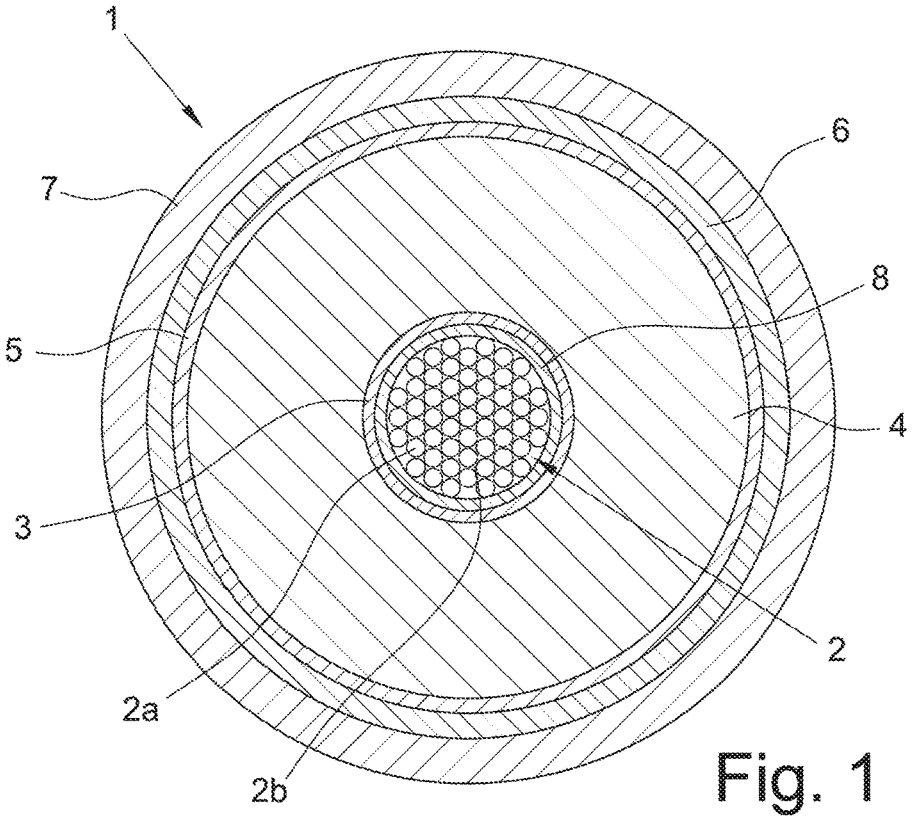
FIG. 1 is a transversal cross section of a first embodiment of an energy cable, particularly suitable for medium or high voltage, according to the present invention.

In FIG. 1, a transversal section of a first preferred embodiment of a cable (1) according to the present invention is schematically represented, which comprises an electric conductor (2), a cross-linked electrically insulating system composed by an inner semiconducting layer (3), an electrically insulating layer (4) and an outer semiconducting layer (5), a metal screen (6) and a sheath (7). Electric conductor (2), inner semiconducting layer (3), electrically insulating layer (4) and outer semiconducting layer (5) constitute the core of cable (1). Cable (1) is particularly intended for the transport of medium or high voltage current.

The conductor (2) consists of metal filaments (2*a*), preferably of copper or aluminium or both, stranded together by conventional methods. The electrically insulating layer (4), the semiconducting layers (3) and (5) are made by extruding and cross-linking polymeric materials according to known techniques. Around the outer semiconducting layer (5), a metal screen layer (6) is usually positioned, made of electrically conducting wires or strips helically wound around the cable core or of an electrically conducting tape longitudinally wrapped and overlapped (preferably glued) onto the underlying layer. The electrically conducting material of said wires, strips or tape is usually copper or aluminium or both. The screen layer (6) may be covered by a sheath (7), generally made from a polyolefin, usually polyethylene, in particular high density polyethylene.

In accordance with an embodiment of the present invention, a tape (8) wherein the zeolite particles are dispersed is wound around the conductor (2) and the inner semiconducting layer (3) is extruded thereon.

The zeolite particles can be dispersed in a filling material, preferably a buffering filling material which is placed among the filaments (2*a*) of the electric conductor (2) in order to avoid propagation of water or humidity that can penetrate within the cable conductor (2), especially when the cable (1) is to be installed in very humid environments or under water.

The filling material is preferably a polymeric filling material which can be provided in the cable core by a continuous deposition process, especially by extrusion or by pultrusion. The filling material can comprise a polymeric material and, advantageously, a hygroscopic material, for example a compound based in an ethylene copolymer, for example an ethylene/vinyl acetate copolymer, filled with a water absorbing powder, for example sodium polyacrylate powder.

Figure 2:
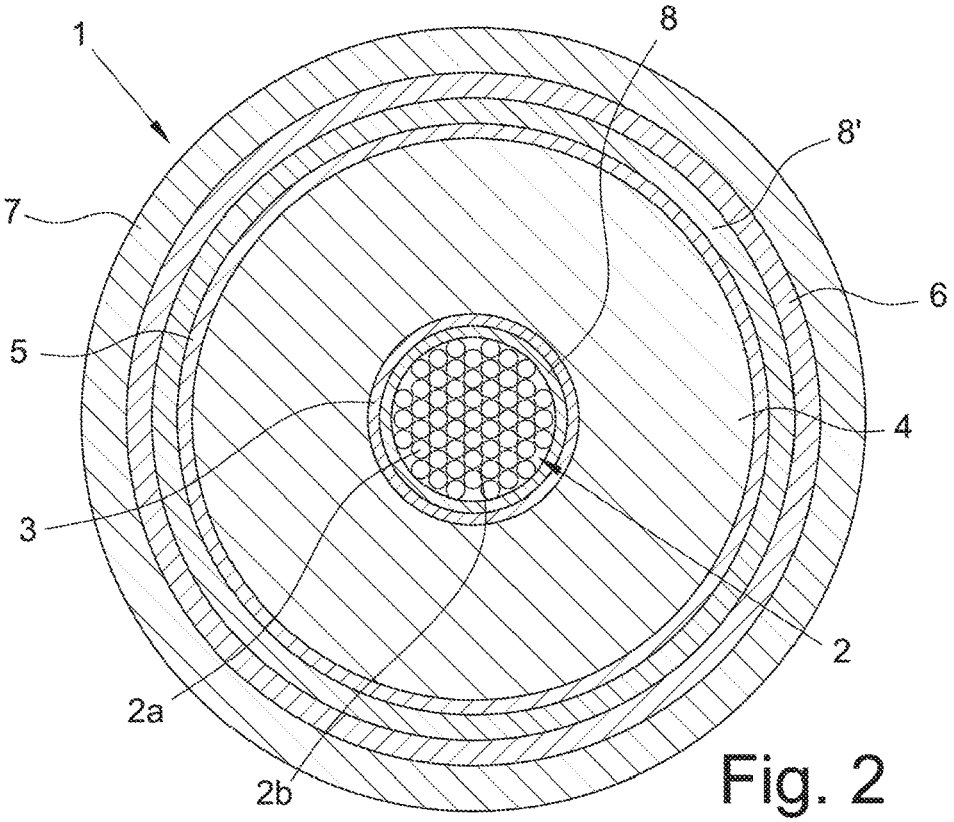
FIG. 2 is a transversal cross section of a second embodiment of an energy cable, particularly suitable for medium or high voltage, according to the present invention.

In FIG. 2, a transversal section of another embodiment of the cable (1) according to the present invention is schematically represented, which comprises the same elements as described in FIG. 1, with the addition of a tape (8'), wound onto the outer semiconducting layer (5), wherein the zeolite particles are dispersed. In a further embodiment, the zeolite particles may be also dispersed in a filling material placed within voids (2*b*) among the metal filaments (2*a*) forming the electric conductor (2).

FIGS. 1 and 2 show only two embodiments of the present invention. Suitable modifications can be made to these embodiments according to specific technical needs and application requirements without departing from the scope of the invention.

The following examples are provided to further illustrate the invention.

EXAMPLES 1-3

Some tests were carried out to evaluate the ability of tapes with zeolite particles to absorb by-products deriving from crosslinking reaction of polyethylene with cumyl peroxide and in particular cumyl alcohol, one of the major of these by-products.

The tape carried zeolite particles. The zeolites particles were CBV 600 (Y-type zeolite having: charge compensating cation=$H^+$; specific surface area=660 $m^2/g$; $SiO_2/Al_2O_3$ ratio=5.2; $Na_2O$ %=0.2; dimensionality=3; maximum diffusing sphere diameter=7.35 Å).

The tape was placed between the conductor and the inner semiconducting layer and, optionally, also around the outer semiconducting layer of cables having a conductor cross-section of 1800 $mm^2$, where the inner semiconducting layer had an inner diameter of about 51 mm and the outer semiconducting layer had an outer diameter of about 97 mm.

The amount of zeolite particles placed between the conductor and the inner semiconducting layer (SCI) only was of 0.0059 $g/cm^3$. The amount of zeolite particles tape placed between the conductor and the inner semiconducting layer (SCI) and also around the outer semiconducting layer (SCE), the amount of zeolite particles in the cable was of about 0.011 $g/cm^3$ (0.0059 $g/cm^3$ between the conductor and the inner semiconducting layer+0.0059 $g/cm^3$ around the outer semiconducting layer). One of the tested cables contained no zeolite particles.

The concentrations of cross-linking by-products were measured by column gas chromatography of a sample of cross-linked insulating system material.

The tests were carried out on cables kept at 70° C.). The results are reported in Table 1.

TABLE 1

| Example | Zeolite tape position | Cross-linking by-products concentration (%) day 0 | day 26 | day 45 |
|---|---|---|---|---|
| 1 (*) | (none) | 0.76 | — | 0.28 |
| 2 | SCI | 0.79 | 0.40 | — |
| 3 | SCI+/SCE | 0.78 | 0.37 | — |

TABLE 2

| Example | Zeolite tape position | Cumyl alcohol concentration (%) day 0 | day 26 | day 45 |
|---|---|---|---|---|
| 1 (*) | (none) | 0.47 | — | 0.20 |
| 2 | SCI | 0.50 | 0.23 | — |
| 3 | SCI + SCE | 0.48 | 0.21 | — |

The example marked with an asterisk (*) is comparative.
SCI = tape with zeolite placed between the conductor and the inner semiconducting layer (amount 0.0059 $g/cm^3$)
SCI + SCE = tape with zeolite placed between the conductor and the inner semiconducting layer and around the outer semiconducting layer (amount 0.011 $g/cm^3$)

From the data reported in Table 1, it is apparent that in the Example 2 and 3 according to the invention the zeolites are able to reduce the cross-linking by-products concentration and, in particular, the cumyl alcohol concentration in substantially shorter time than the known degassing procedure even when used in reduced amount The additional presence of zeolite particles in the outer semiconducting layer (cable of Example 3) improves the reduction of cross-linking by-products, but its effect seems to be less significant than that of the presence of zeolite particles placed between the conductor and the inner semiconducting layer.

EXAMPLE 4

The insulating system of a cable analogous to that of Example 1 was analyzed after about 20 days at 70° C. from the manufacturing and the overall cross-linking by-products content was found to be reduced from 1.3% down to 0.37% (the cumyl alcohol content was found to be reduced from 0.82% down to 0.22%). After about one year (spent at room temperature) another analysis was carried out and the cross-linking by-products content was found to be further reduced to substantially 0%.

From these data, we can derive that the zeolite particles placed in the vicinity of the insulating system of an energy cable are able to reduce, down to substantial elimination, the crosslinking by-products not only during degassing heating but also during storage of the cable at ambient temperature.

The reduction of the cumyl alcohol concentration in the insulating system implies the compound diffusion radially towards both the inside of the insulating system (where it is adsorbed by the zeolite particles) and outside the insulating system (where it can be dispersed in the atmosphere). The diffusion time is important and is expected to depend on the insulating system thickness.

In past estimations, for a 25 mm insulating thickness an amount of at least 70 g/m zeolite particles (which corresponds to about 0.01 $g/cm^3$ for a 2000 $mm^2$ conductor cable) was contemplated to reach a final target of 0.32 wt % of cumyl alcohol content in the insulating system after a 25 days degassing period at 70° C., while for a 15 mm insulating thickness an amount of at least 27 g/m zeolite particles (which corresponds to about 0.005 $g/cm^3$ for a 1100 $mm^2$ conductor cable) was contemplated to reach the same final target above.

These values were considered for taking into account the different length of the cumyl alcohol diffusion path to reach either the absorbing material or the external atmosphere.

Surprisingly, it has been found that even with a significantly high thickness, a relatively low amount of zeolite particles is sufficient to reach and exceed the desired residual cumyl alcohol concentration, as confirmed by Example 2 and 3 above.

The invention claimed is:

1. An energy cable comprising at least one cable core comprising an electric conductor, a crosslinked electrically insulating system comprising an inner semiconducting layer, an insulating layer and an outer semiconducting layer, and zeolite particles placed between the electric conductor and the inner semiconducting layer, wherein the insulating layer is external to the inner semiconducting layer, and further wherein the zeolite particles are present in an amount less than 0.01 g/cm$^3$ with respect to the volume of the cross-linked insulating system.

2. The energy cable according to claim 1, wherein the zeolite particles are placed in contact with the inner semiconducting layer.

3. The energy cable according to claim 1, wherein the zeolite particles are further placed into or in contact with the outer semiconducting layer.

4. The energy cable according to claim 3, wherein the zeolite particles are placed in contact with the outer semiconducting layer.

5. The energy cable according to claim 1, wherein the zeolite particles are dispersed on a substrate, the substrate comprising a yarn or a tape.

6. The energy cable according to claim 1, wherein the zeolite particles are present in an amount at most of 0.008 g/cm$^3$ with respect to the volume of the cross-linked insulating system.

7. The energy cable according to claim 1, wherein the zeolite particles have a charge compensating cation selected from the group consisting of ammonium ($NH_4^+$) and hydron ($H^+$).

8. The energy cable according to claim 1, wherein the zeolite particles have a $SiO_2/Al_2O_3$ molar ratio equal to or lower than 20.

9. The energy cable according to claim 1, wherein the zeolite particles have a $SiO_2/Al_2O_3$ molar ratio equal to or lower than 15.

10. The energy cable according to claim 1, wherein the zeolite particles have a maximum diameter of a sphere that can diffuse along at least one of the cell axes directions equal to or greater than 3 Å.

11. The energy cable according to claim 1, wherein the zeolite particles have a sodium content, expressed as $Na_2O$, equal to or lower than 0.3% by weight.

12. A method for extracting crosslinking by-products from a cross-linked electrically insulating system of an energy cable core, said method comprising the following sequential stages:

manufacturing an energy cable core comprising an electric conductor, a crosslinked electrically insulating system containing cross-linking by-products and comprising an inner semiconducting layer, an insulating layer and an outer semiconducting layer, and zeolite particles placed between the electric conductor and the inner semiconducting layer, wherein the zeolite particles are present in an amount less than 0.01 g/cm$^3$ with respect to the volume of the cross-linked insulating system;

heating the energy cable core up to a temperature causing migration of the crosslinking by-products from the crosslinked electrically insulating system to the zeolite particles, thereby the zeolite particles absorb the cross-linking by-products; and then placing a metal screen around the energy cable core.

13. The method according to claim 12, wherein the heating step is carried out at a temperature of from 70° C. to 80° C., for a time from 7 to 15 days.

14. The method according to claim 12, wherein the heating step causes at least one fraction of the crosslinking by-products to be irreversibly absorbed into the zeolite particles.

* * * * *